United States Patent [19]

Ross et al.

[11] Patent Number: 4,844,154

[45] Date of Patent: Jul. 4, 1989

[54] WELL PACKER

[75] Inventors: Colby M. Ross; Pat M. White, both of Carrollton, Tex.

[73] Assignee: Otis Engineering Corporation, Dallas, Tex.

[21] Appl. No.: 210,232

[22] Filed: Jun. 23, 1988

[51] Int. Cl.[4] ..... E21B 33/128; E21B 33/129

[52] U.S. Cl. ..... 166/139; 166/140; 166/216; 166/237

[58] Field of Search ..... 166/138, 139, 140, 217, 166/216, 237

[56] References Cited

U.S. PATENT DOCUMENTS

| | | | |
|---|---|---|---|
| 2,720,267 | 10/1955 | Brown | 166/138 X |
| 2,720,924 | 10/1955 | Brown | 166/138 |
| 2,795,281 | 6/1957 | Christian | 166/138 X |
| 3,279,542 | 10/1966 | Brown | 16/216 X |
| 3,467,184 | 9/1969 | Young | 166/138 X |
| 4,018,274 | 4/1977 | Cochran | 166/138 X |
| 4,524,825 | 6/1985 | Fore | 166/139 |
| 4,671,354 | 6/1987 | Henderson et al. | 166/140 X |

*Primary Examiner*—Stephen J. Novosad

*Attorney, Agent, or Firm*—Johnson & Gibbs

[57] ABSTRACT

A well packer for sealing an annular space within a well bore around a tubing string including a tubular mandrel, an expandable seal assembly on the mandrel for sealing around the mandrel with a well bore wall, a slip assembly on the mandrel for releasably locking the packer with the well bore wall, a drag spring and slip carrier assembly around the slip assembly, and an interlock assembly for selectively coupling the drag spring and slip carrier assembly with the mandrel for operating the packer through running, set, and release modes. The packer also includes an emergency release feature for releasing the packer in the event that well obstructions or other problems prevent normal rotation of the tubing string and mandrel to operate the interlock assembly.

32 Claims, 5 Drawing Sheets

WELL PACKER

BACKGROUND OF THE INVENTION

1. Field of the Invention

This invention relates to well packers which may be set and reset without retrieval to the surface in various well applications such as injection, production, and disposal wells.

2. History of the Prior Art

It is well known in the well art, and particularly in the oil and gas industry, to use well packers in the bore of a well around the well tubing to seal the annulus between the well tubing and the well bore wall for isolating one or more vertical portions of the well bore. Well packers are used in testing, treating, and producing wells and in disposal well applications. These various and diverse systems employing well packers involve a wide range of depths at which the packers are used, environments which may produce extremes of high temperature and pressure as well as corrosive fluids, brine solutions, water, steam, and other natural formation fluids and fluids used in treating and producing wells. These various applications require a maximum of pressure sealing and corrosion resistance when left in place over long periods of time. In addition to the need for functioning in extreme hostile environments, the high cost of running, setting, and pulling packers in wells which requires handling equipment at the surface, as well as substantial periods of shut-down time, make it highly desirable to use packers capable of release and reset within a well bore without removal. It is particularly desirable for such a packer to be simple in construction with a minimum number of parts utilizing such features as one-piece locking slips, wherein one end of such slips is set initially before fully expanding the annular seal assembly prior to setting the slips to achieve maximum leak-free seals. Well packers capable of performing these desired functions, particularly for service under the adverse conditions described, require very high quality expensive materials which make such packers quite costly to manufacture. Thus, it is also desirable to reduce the physical size, particularly the length, of such special application packers to minimize the use of the necessary expensive materials, thereby reducing the cost of the packers. Typical well packers having some features in common with the present invention, but however, lacking the particular improvements of the present invention are shown in the following U.S. Pat. Nos. 3,467,184; 4,296,806; 4,524,825; and 4,671,354.

SUMMARY OF THE INVENTION

It is a particularly important object of the invention to provide a new and improved well packer.

It is another object of the invention to provide a new and improved well packer useful under a variety of well applications and adverse conditions, such as found in some injection, production, and disposal wells.

It is another object of the invention to provide a well packer having an interlocking assembly operable in a running mode, a set mode, and a release mode permitting the packer to be set and released in a well, run to another location, and reset in the well without retrieval to the surface.

It is another object of the invention to provide a well packer in which the interlock assembly is combined with the packer slip assembly to drastically reduce the length of the packer.

It is another object of the invention to provide a short, compact, corrosion-resistant packer that can be set at any depth in a well bore.

It is another object of the invention to provide a well packer having one-piece slips wherein one end of the slips is initially set and the packer elements are partially expanded prior to the setting of the other ends of the slips and the full expansion of the slips and packer elements.

It is another object of the invention to provide a well packer which may be set and held in tension in a neutral condition or in compression.

It is another object of the invention to provide a packer which can be set and reset while retaining maximum capability of withstanding pressures and without removal from the well bore.

It is another object of the invention to provide a well packer which may be released under emergency conditions by application of a straight or longitudinal force if the tubing string cannot be rotated.

It is another object of the invention to provide a well packer which withstands pressure from either direction across the packer.

It is another object of the invention to provide a well packer in which the slip and slip carrier structure is combined with the drag spring assembly for reduction of the length of the packer.

It is another object of the invention to provide a well packer which includes new and improved slip springs reducing the manufacturing time and expense required in prior coil spring operated packer slips.

In accordance with the invention, there is provided a well packer having a tubular body mandrel with a longitudinal central flow passage, an annular packer element assembly on the body mandrel expandable to seal an annular space between body mandrel and a well bore wall surface, a drag spring and locking slip assembly on the mandrel for releasably locking the packer along a well bore, and an interlock assembly associated with the slip and drag spring assembly for selectively coupling the drag spring and slip assembly with the body mandrel for setting and releasing the packer responsive to longitudinal and rotational motion of the body mandrel.

One embodiment of the invention includes spaced external running and setting-locking threads on the mandrel and an assembly of circumferentially spaced running and setting-locking segments within the drag spring assembly having internal threads formed in opposite directions for selective mating with the mandrel threads for running and setting and locking the packer. In another embodiment of the invention, the mandrel has external threads formed in a single direction, a J-slot flange on the drag spring assembly operating with a lug ring on the mandrel for running and pulling the packer and circumferentially spaced setting and locking segments within the drag spring assembly having internal threads cooperating with the threads on the mandrel for setting and locking the packer.

BRIEF DESCRIPTION OF THE DRAWING

The foregoing objects and advantages of the invention together with the specific details of a preferred embodiment will be better understood from the following detailed description taken in conjunction with the accompanying drawings wherein.

DETAILED DESCRIPTION OF THE PREFERRED EMBODIMENT

Figure 1:
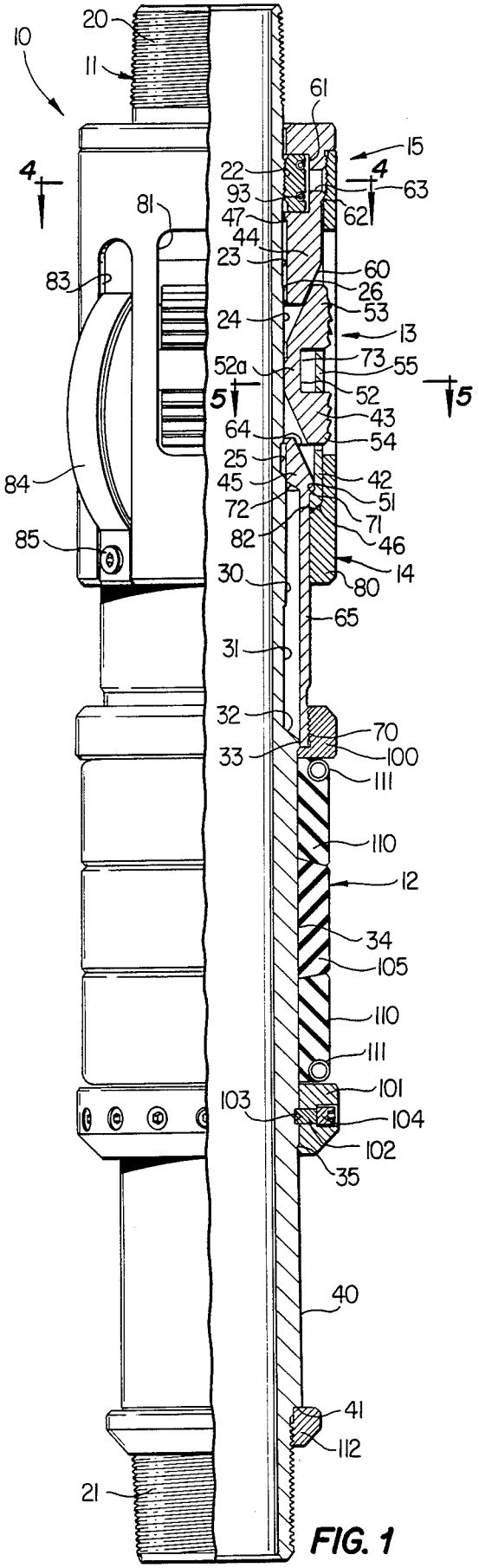
FIG. 1 taken together form a longitudinal view in section and elevation of the well packer in a running mode.
Figure 4:
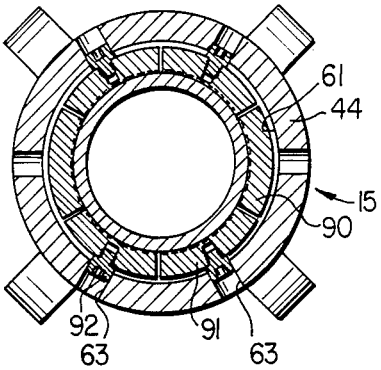
FIG. 4 is a view in section along the line 4—4 of FIG. 1, showing, in particular, the running and locking segments of the interlock assembly.
Figure 5:
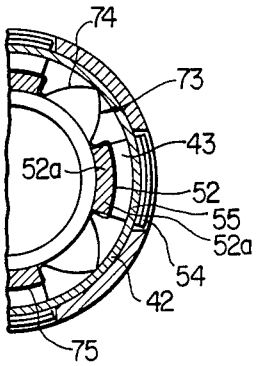
FIG. 5 is a fragmentary view in section along the line 5—5 of FIG. 1.

Referring to FIGS. 1, 4, and 5, a well packer 10 embodying the features of the invention includes a tubular mandrel 11, a packer element assembly 12, a locking slip assembly 13 in a drag spring and slip carrier assembly 14, and an interlock assembly 15 within the slip assembly and drag spring assembly for selective coupling with the mandrel in the various operating modes of the packer. The packer may be run into a well bore, set, released, reset, and retrieved by a series of manipulations involving a sequence of steps of raising, lowering, and turning the tubing string and mandrel. The inter action between the slip assembly, the drag spring assembly 14, and the interlock assembly with the mandrel 11 provides the necessary slip expanding and retracting functions for setting and releasing the packer in a well bore.

Referring to FIG. 1, the mandrel 11 is threaded at 20 along an upper end portion and at 21 along a lower end portion. The external configuration of the mandrel 11 includes a section 22 of left hand threads, a slightly reduced outer smooth wall section 23, a section 24 comprising right hand threads, an external annular recess 25 below the threads 24, a slightly enlarged wall section 30, a reduced diameter portion 31, an upwardly facing downwardly tapered stop shoulder 32 at the lower end of the section 30, a stop flange 33 below the shoulder 32, a smooth outer wall section 34 for the packer element assembly, an external downwardly facing stop shoulder 35 at the lower end of the section 34, and an outer wall portion 40 of slightly reduced diameter below the section 34 terminating in a downwardly facing annular stop shoulder 41.

Figure 7:
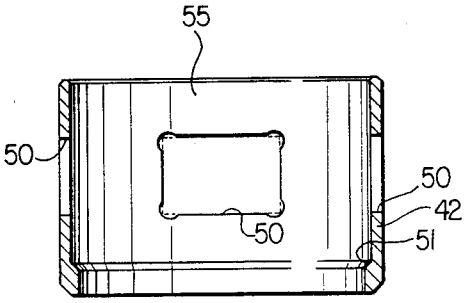
FIG. 7 is a view in section and elevation of the slip housing of the packer.

The slip assembly 13 includes a slip housing 42 shown in detail in FIG. 7, a plurality of slips 43, an upper wedge and interlock assembly retainer ring 44, and a lower wedge 45. As best seen in FIG. 7, the slip housing has circumferentially spaced rectangular slip windows 50, each sized and shaped to permit the expansion and retraction of a slip 43 while holding the slip on the mandrel as evident in FIG. 1A. The internal diameter of the lower end portion of the housing 42 is reduced to provide an upwardly facing operating shoulder 51 which cooperates with an operating shoulder, described hereinafter, on the wedge 45 during the operation of the slip assembly. Each of the slips 43 is an arcuate shaped member slightly narrower than the arcuate length of the window 50 in the housing 42. A central lateral recess 52 extends across the slip dividing the slip into an upper externally toothed portion 53 and a lower toothed portion 54. The housing 42 has a lateral retainer portion 55 which is an integral part of the body of the housing above each of the windows 50, as seen in FIG. 7, which holds each of the slips disposed in each of the windows. As evident in FIG. 1A, the retainer portion 55 fits within the slip recess 52 so that as each slip expands and retracts the upper portion 53 of the slip is above the upper end edge of the housing 42 while the lower portion 54 of the slip moves in and out in the slip window 50, the housing retainer portion 55 serving as a guide and keeping the slip from falling out of the slip assembly. The upper wedge and interlock assembly retainer ring 44 has a downwardly and inwardly sloping slip expander surface 60 for engaging and expanding the upper ends of the slips 43 and an internal annular recess 61 which contains the interlock assembly, shown in more detail in FIG. 4. The member 44 is secured by external threads 62 in the upper end of the drag spring housing 14. The member 44 has a plurality of circumferentially spaced, radial holes 63 for retainer screws which hold the interlock assembly 15 in the member as seen in FIG. 4. The lower slip expander wedge 45 has an upwardly and inwardly sloping expander surface 64 and a tubular body 65 externally threaded along a lower end portion 70 which is secured in the upper retainer ring of the packer element assembly 12, as described hereinafter. The wedge 45 has an external annular operating shoulder 71 and an internal stop flange 72.

The slips 43 are biased inwardly within the housing 42 around the mandrel 1 by four formed springs 73 arranged in annular, end-to-end, array around the mandrel within the slip housing 42 to aid in holding the slips 43 properly positioned around the mandrel and to bias the slip inwardly toward the mandrel. Each of the springs 73 has straight opposite end sections which bend when stressed to resemble one half of a parabola and a central integral section 75 which is sized and shaped as a circular segment to fit around and hold the central portion 52*a* of the slip. Each spring 73 encompasses 90 degrees of the annular space around the mandrel within the slip housing 42 in which the slips are installed. The use of the formed springs 73 substantially reduces the cost of the slip assembly over coil springs as illustrated in Pat. No. 4,671,354, because the slip machining required for the coil springs is substantially more expensive than that required for the central portion 52*a* of the slips in the present invention to accommodate the slips to the formed springs.

Figure 6:
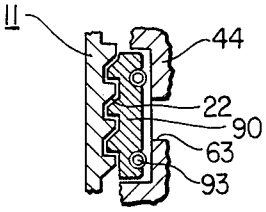
FIG. 6 is a schematic fragmentary view in section of a portion of the tubular body mandrel and one of the segments of the interlock assembly showing the thread configuration employed on the mandrel and in the segments of the interlock assembly.

The drag spring and slip carrier assembly 14 includes a tubular slip carrier 80 internally threaded as previously described, along an upper end portion secured to the upper wedge and interlock assembly ring 45. The slip carrier has circumferentially spaced slip windows 81, sized and shaped to permit expansion and contraction of the slips and longitudinal motion of the slips and the slip housing 42 necessary for setting and releasing the packer in a well bore. The lower end portion of the slip carrier 80 has a reduced diameter bore sized to fit in sliding relation around the bottom wedge housing 65 and provided with a downwardly and inwardly sloping stop shoulder 82 engageable by the tapered lower end 46 of the slip housing 42 limiting the relative downward movement of the slip housing and slips within the slip carrier. The outer wall of the slip carrier 80 is provided with circumferentially spaced downwardly opening drag spring recesses 83. An outwardly bowed multilayered drag spring 84 is secured along a lower end portion in each of the recesses 83 by a retainer screw 85. Only the lower end portion of the drag spring is secured to the slip carrier so that each drag spring may spread and extend longitudinally within the recess 83 as it is compressed inwardly moving along a well bore. The drag springs are designed when compressed radially to engage a well bore wall sufficiently to provide enough friction resisting movement of the slip carrier 80 to permit the necessary slip and interlock assembly functions for locking and releasing the packer The interlock assembly 15 provides the necessary coupling between the mandrel 11 and the slip assembly 13 for locking and releasing the packer. The interlock assembly, as shown in Figs. 1A and 4, is mounted within the top wedge and ring 44 in the recess 61 around the mandrel 11. The interlock assembly includes internally threaded running segments 90 and locking segments 91, which are arranged in end-to-end circular array around the mandrel within the ring 44, as seen in FIG. 4. Each of the segments extends approximately 15 degrees around the annular space between the mandrel and the retainer ring. The two running segments 90 are spaced 180 degrees apart with two pairs of the locking segments arranged end-to-end around opposite sides 180 degrees apart between the running segments. The segments 91 are each loosely held in position by a socket head screw 92. The shank of each of the screws 92 is threaded into a locking segment 91 and the head of the screw fits loosely within a bore 63 of the member 44 so that the locking segments can move radially but cannot travel circumferentially around the annular space between the mandrel 11 in the member 44. The running segments 90 are captured between the locking segments. A pair of garter springs 93 are arranged around the assembly of running and locking segments as seen in both FIGS. 1 and 6, passing across the segments in the semi-circular recesses provided in the outer surface cf each of the segments. The garter springs hold the segments 90 and 91 snugly around the mandrel against the threads 22 on the mandrel in the running mode of FIG. 1. The running segments 90 have internal left-hand thread sections extending the circumferential length of the segments shaped and sized to coact with the left-hand threads 22 on the mandrel. FIG. 6 shows in enlarged fragmentary form the thread configuration and the relationships between the mandrel threads and the running slip threads. The threads are a buttress type thread having one face perpendicular to the longitudinal axis of the mandrel 11 and the other face tapered with respect to such longitudinal axis. As shown in FIG. 6, the mandrel threads have a perpendicular upper face and a tapered lower face. To conform to the left-hand mandrel threads 23 the thread sections within the running segments 90 have perpendicular lower faces and tapered upper faces. This relationship permits a racheting action between the running segments 90 and the mandrel when the mandrel is urged downwardly relative to the running segments. The thread sections in the locking segments 91 and the mandrel threads 24 are right-hand threads of the same buttress design with the thread orientation and relationship between the mandrel threads and the locking segment threads being the reverse of that shown in FIG. 6. Stated otherwise the threads 24 on the mandrel have downwardly sloping upper faces and perpendicular lower faces. The thread sections within the locking segments 91 have perpendicular upper faces and sloping lower faces. Thus, the locking segments will freely move down or rachet down on the mandrel threads 24 as there is little resistance to the downward movement of the locking segments. The perpendicular faces of the threads 24 and in the locking segments 91 prevent the locking segments from moving upwardly on the mandrel threads, however. It will be recognized that with the use of both right and left hand threads on both the mandrel and within the running and locking segments that the right-hand threaded parts will not fit the left-hand threaded part. Thus, when the interlock assembly is at the running position, as in FIG. 1, the right-hand thread sections in the locking elements 91 will not mesh with the left threads 22 on the mandrel; and thus the locking slips threads extend across the left hand threads, and the locking slips simply slide along the outer face of the mandrel threads. Similarly, when the interlock assembly is at the lower position on the mandrel threads 24, the right-hand threads on the mandrel will mesh in the locking elements 91 while the left hand threads of the running elements 90 will not mesh, and thus, the running elements will simply slide along the outer surface of the threads 24. The radial depth of the recess 61 in the retainer ring 44 is sufficient that the running segments and the locking segments may move radially outwardly against the garter springs sufficiently for the non-meshing segments to slide along the non-meshing mandrel threads.

The packer element assembly 12 is mounted on the mandrel along the mandrel section 34 below the flange 33 between a top element retainer ring 100 and a bottom element retainer ring 101. The retainer ring 100 threads on the lower end of the housing section 65 of the lower wedge 45. The inner diameter of the ring 100 forms a sliding fit with the mandrel section 34 below the flange 33 so that the mandrel may move up for compressing the packer element assembly. The lower retainer ring 101 is held on the mandrel engaged with the stop shoulder 35 by shear pins 102 which extend into an external annular shear pin recess 103 on the mandrel. The shear pins are held in place in the ring 101 by socket head screws 104. The seal element assembly 12 includes a central element 105 and upper and lower elements 110 each of which has an embedded spring 111 to aid in resisting extrusion of the packer element material when expanded in sealed relationship against a casing wall. The seal elements are of an elastomeric construction which may include a combination of suitable metallic and non-metallic materials capable of withstanding high pressures as well as corrosive fluids, such as $CO_2$ and $H_2S$. A catcher ring 112 is threaded on the lower end of the mandrel 111 against the stop shoulder 41 for retaining the seal element assembly and other components of the packer on the mandrel under circumstances where the packer must be pulled by shearing the pins 102 as explained hereinafter.

OPERATION

When the well packer 10 of the invention is to be run and set in a well bore, the packer is connected on at the lower end of a tubing string, not shown, or as an integral part of the tubing string, with sections of tubing above and below the packer. Connections with the upper and lower ends of the packer are made with the threaded mandrel end portions 20 and 21 at the upper and lower ends, respectively, of the packer. The packer is lowered on the tubing string in the running mode illustrated in FIG. 1. In this mode the interlock assembly 15 is engaged with the mandrel threads 22. The threads of the running segments 90 are meshed with the mandrel threads 22 holding the upper wedge 44 at the upper end position illustrated so that the upper wedge and lower wedge 45 do no engage the slips 54 and the springs 73 hold the slips at the inward retracted positions shown. The locking elements 91 of the interlock assembly are riding on the threads because they are right-hand thread portions and the threads 22 are left hand threads. As the packer is lowered in the well bore the drag springs 84 drag along the well bore wall opposing the downward movement of the packer, and thus, effectively applying a relative upward force to the slip carrier 14. Since the running segments 90 are engaged with the threads 22 on the mandrel, the interlock assembly prevents any movement of the slip carrier relative to the mandrel so that the slip carrier and drag springs move with the mandrel down the well bore. At the desired depth in the well bore, the tubing is picked up raising the mandrel 11 with the drag springs 84 resisting upward movement. The tubing and mandrel 11 are rotated clockwise as the mandrel is lifted. Turning of the mandrel clockwise rotates the left-hand threads on the mandrel which drives the left-hand threaded running segments 90 downward relative to the mandrel until the running segments are disengaged from the threads 22 and aligned with the smooth mandrel wall 23 below the threads 22. During this rotating of the mandrel, unless the mandrel is lifted, the angle of the threads on the mandrel and within the running segments would simply cause the segments to rachet over the mandrel threads without rotating off of the left-hand threads 22 of the mandrel. With the lifting of the mandrel, however, the racheting does not occur and the running segments do move relative to the mandrel to the smooth wall section of the mandrel. This, of course, releases the interlock assembly along with the slip carrier 80 and slip assembly 13 from the mandrel. If the mandrel were only rotated without lifting, and since the running segments are coupled with the slip carrier and drag springs, the drag springs would resist the downward movement of the segments and because of the thread angles the running segments would simply move out and over the mandrel threads racheting from one thread to the next thread and not moving off of the threaded section. By lifting the mandrel while rotating this does not occur. As soon as the running segments 90 move below the mandrel threads 22 to the smooth mandrel section 23, the mandrel is uncoupled from the drag spring assembly 14 and the slip assembly 13 so that the mandrel may move up relative to such assemblies. Continued upward movement of the mandrel lifts the bottom ring 101, the seal element 12, the top ring 100, and the wedge housing 65 with the bottom slip wedge 45, while the drag springs 84 resist upward movement of the drag spring assembly including the slip carrier 80, the slip housing 42, and the slips 43. The bottom wedge 45 is raised under the lower ends of the slips 43 forcing the slips outwardly with the teeth on the slips engaging the wall of the well bore. Continued lifting of the mandrel then compresses the packer elements of the assembly 12 as the bottom ring 101 is lifted and the mandrel flange 33 moves upwardly within the top packer element retainer ring 100 bringing the bottom ring 101 closer to the top ring 100 so that the packer elements are compressed longitudinally and expand radially. During this upward movement of the packer mandrel, while the interlock assembly is restrained from upward movement by the drag springs, the mandrel threads 24 move into the interlock assembly with the locking segments 91 racheting along the threads 24; and since the threads 24 are right-hand threads and the threads in the elements 91 are right-hand threads, when the threads are in proper alignment the garter springs 93 around the elements will force the elements 91 inwardly so that the element threads engage the mandrel threads 24. The interlock assembly is now connected with the mandrel through the locking elements 91 and the mandrel is lowered by the tubing string forcing the top wedge 44 downwardly under the upper ends of the slips 43. The lower faces of the mandrel threads 24 are perpendicular to the mandrel so that during this downward force on the mandrel and the locking slips 91, which also have perpendicular thread portions engaging the perpendicular thread portions on the mandrel, the wedge 44 is forced downwardly. The weight of the tubing string on the mandrel together with any downward force applied to the tubing string applied through the locking elements 91 to the top wedge 44 and the drag spring assembly overcomes the friction of the drag springs and forces the wedge 44 under the upper ends of the slips 43. Since the slips are mounted in the slip housing 42 in the slip carrier 80 around the housing and the slip housing is movable relative to the slip carrier, the wedge, along with the slip carrier and the drag springs, may move downwardly relative to the slips. During this downward movement to drive the upper wedge 44 under the upper ends of the slips, the slips are maintained engaged by the compressed packer element assembly 12 which acts as a spring keeping the lower wedge 45 engaged with lower ends of the slips 43. During the downward movement of the mandrel for setting the upper wedge 44, it will be recognized that there will be some downward movement of the lower element retainer ring 101 which will tend to allow the packer element assembly 12 to somewhat relax, and thus, some of the set in the element assembly is lost during the setting of the upper wedge. The spring effect of the elements during the setting of the upper wedge has functioned to maintain the lower wedge in position. It is now necessary to again pick up on the tubing string pulling the mandrel back upwardly to restore the full expansion or set in the packer element assembly 172. As the mandrel is pulled upwardly, the mandrel threads 24 move within the interlock assembly with the locking elements 91 racheting outwardly, as previously described, until the upward movement of the mandrel stops at which time the elements 91 will engage the threads 24. The mandrel is pulled upwardly forcing the bottom packer element retainer ring 101 upwardly relative the top retainer ring 100 which is held against upward movement by the wedge housing 65 and the integral wedge 45 under the lower ends of the slips 43. The mandrel moves relative to the housing 65 and the ring 100 as the bottom ring 101 compresses and expands the packer element assembly 12. An upward force is applied to the mandrel to an approximate predetermined value, which, for example, may be 30,000 pounds to fully compress and expand the packer element assembly 12. The inner threaded portions of the locking slips 91 are urged by the garter springs 93 into engagement with the mandrel threads 24 restraining the locking slips from downward movement on the mandrel holding the mandrel at the upper position at which the packer element assembly 12 is fully expanded and the slips 43 are fully set. In this set mode, the tubing string, not shown, may then be held in a neutral condition under which there is no downward or upward force on the mandrel, or the tubing string may be set in compression or tension as the slips will hold the packer against either upward or downward movement in the casing.

Figure 2:
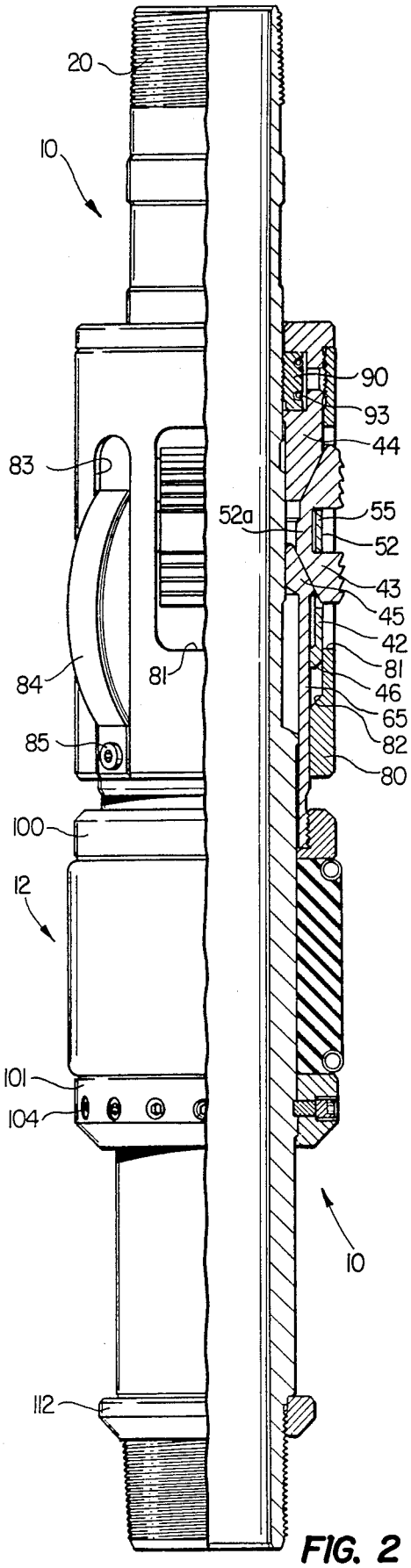
FIG. 2 together form a longitudinal view in section and elevation of the well packer of FIG. 1 in a set mode.

FIG. 2 illustrate the packer in the set mode. The slip housing 42 along with the slips 43 is at an upper position relative to the slip carrier 80 at which the lower end surface 46 of the slip housing is spaced above the tapered shoulder 82 in the slip carrier. The length Of the windows 81 in the slip carrier readily permits the slips to be disposed at this upper position in the slip carrier. During the final setting sequence of the packer, the slip carrier has moved downwardly relative to the slips in accordance with a novel feature of the invention. It will be noted, also, that the top retainer ring 100 along with the lower end of the bottom wedge housing 65 are spaced below the lower end of the slip carrier 80. The upper threads 22 on the mandrel are above the drag spring and slip carrier assembly. The packer will remain set as long as the desired well production and/or well treating processes are carried out in the well bore. The packer element assembly 12 seals off the annulus in the well casing around the mandrel so that well fluids passing up the well bore must pass through the bore of the mandrel.

In accordance with the invention, the packer may be released and reset in the well bore or pulled from the well bore with the tubing string. The first step in releasing the packer is the lowering of the tubing string putting a downward force on the mandrel while simultaneously the mandrel is rotated to the right, or clockwise as seen from above, turning the right-hand threads 24 within the right-hand thread portions of the locking segments 91. The segments 91 are backed off the lower threads 24 of the mandrel. Since the running segments 90 have internal left-hand threaded portions, the segments 90 ride on the outer surfaces of the mandrel threads 24. When the interlock assembly is aligned with the mandrel section 23, the mandrel is released from the drag spring and slip carrier assembly 14. The tubing string and mandrel is then further lowered so that the mandrel moves downwardly within the drag spring and slip carrier assembly, the lower wedge 45 and wedge housing 65, the upper retainer ring 100, and the expanded packer element assembly 12. The bottom retainer ring 100, is moving downwardly with the mandrel releasing the compression in the packer element assembly. When the mandrel flange 33 reaches the top retainer ring 100 the retainer ring is picked up pulling the bottom wedge housing 65 and the bottom wedge 45 downwardly from under the lower ends of the slips 43. The shoulder 71 on the wedge 45 engages the shoulder 51 within the slip housing 42 pulling the slips 43 downwardly off of the upper wedge 44. This occurs because the drag springs 84 hold the slip carrier 80 against downward movement, and, in accordance with the invention, the slip housing 42 moves longitudinally Within the slip carrier 80 permitting the slips 43 to be pulled downwardly relative to the slip carrier. As the mandrel moves downwardly pulling the slips 43 from the top wedge 44, the running segments 90 rachet along the threads 22 on the mandrel, the drag springs 84 holding the drag spring and slip carrier assembly 14 against downward movement, and the locking segments 91 sliding along the threads 22 be cause the locking segments have internal right hand threads and the threads 22 are left hand threads. When the interlock assembly 15 including the running segments 90 moves onto the mandrel threads 22, the packer is fully released and returned to the running mode illustrated in FIGS. 1A and 1B.

The released packer may be pulled from the well bore or may be moved to an another location in the well and reset in accordance with the previously described procedure for initially setting the packer. When the bottom wedge 45 is pulled from beneath the slips 43, and the slips are pulled off the top wedge, the springs 73 retract the slips inwardly around the mandrel. The engagement of the interlock assembly with the mandrel threads 22 keeps the packer in the running mode for pulling or resetting.

When relocating the packer along a well bore, if the tubing string and mandrel are lifted upwardly, the interlock assembly 15 holds the upper wedge 44 above the slips 43 while the bottom wedge 45 is kept at a position spaced below the lower ends of the slips 43 by the flange 33 on the mandrel. If the tubing string and mandrel are lowered, the engagement of the mandrel flange 33 with the ring 100 of the packer element assembly connected with the wedge housing 65 keeps the bottom wedge 45 from moving upwardly under the slips 43 while the top wedge 44 is held as previously described at a position spaced above the upper ends of the slips 43 by the interlock assembly engaged on the mandrel threads 22. Thus, the packer may be moved either upwardly or downwardly without re-engaging the slip wedges with the slips so that the slips remain held inwardly by the springs 73 around the mandrel, in released positions.

Figure 3:
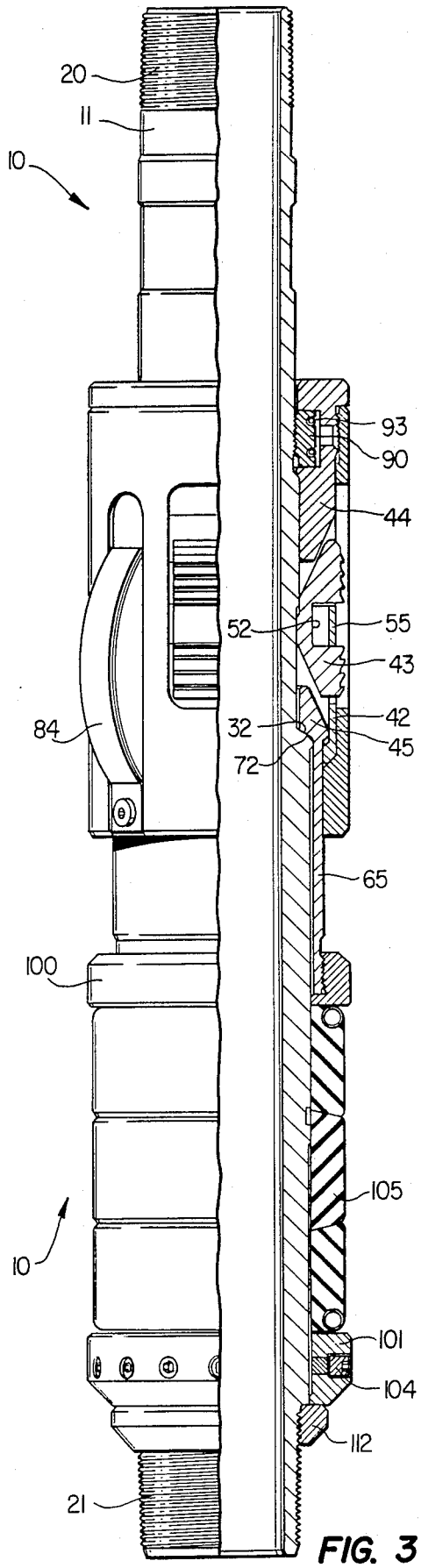
FIG. 3 taken together form a longitudinal view in section and elevation of the well packer in an alternate pulling mode used under emergency conditions.
Figure 8:
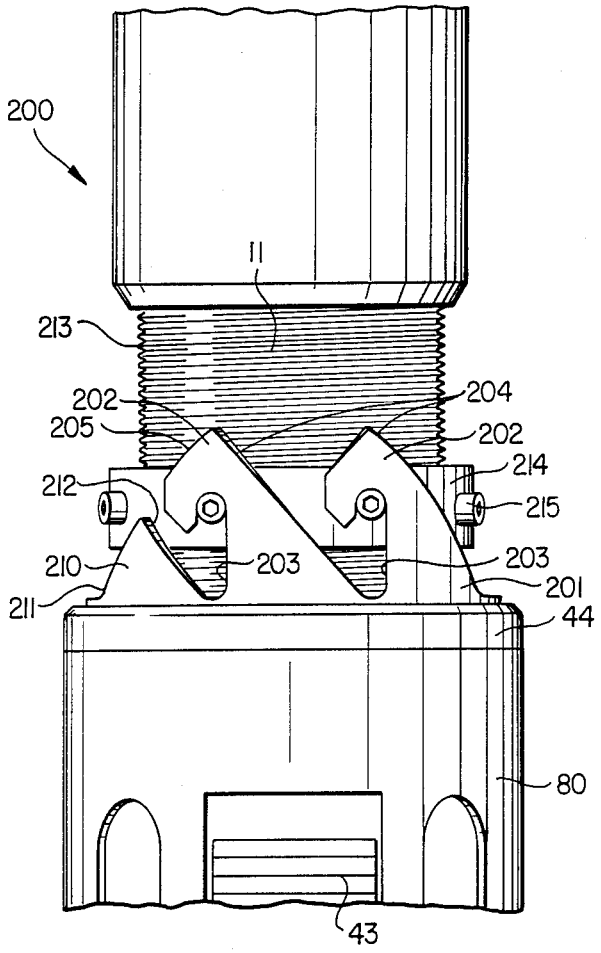
FIG. 8 is a fragmentary view in elevation of an upper end portion of a second embodiment of the packer of the invention connected with the lower end of a tubing string employed for running and setting the packer and operating the well after the packer is set.
Figure 11:
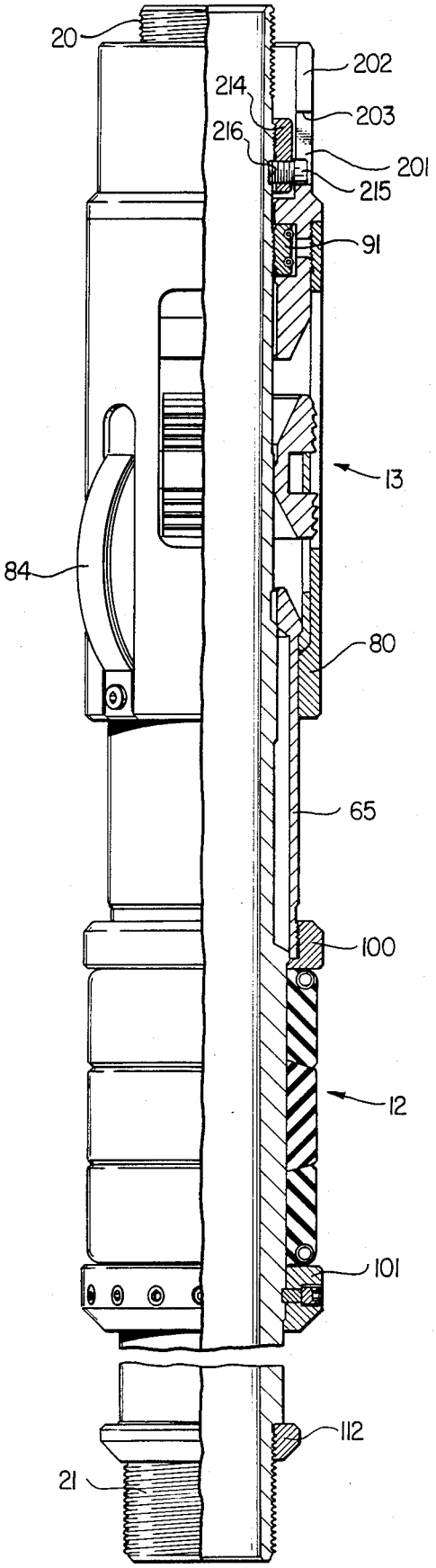
FIG. 11 is a fragmentary longitudinal view in section and elevation of the packer of FIG. 8 in the running mode.
Figure 9:
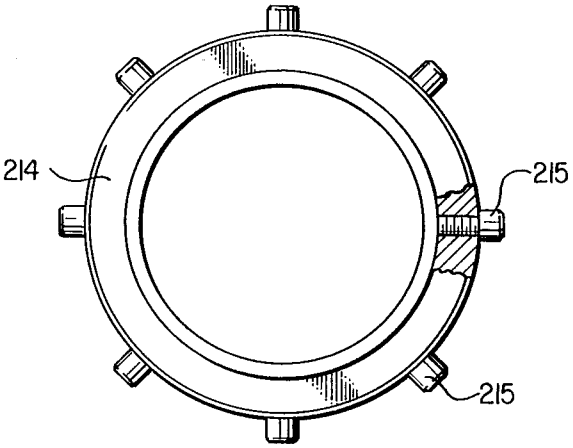
FIG. 9 is a top view, partially broken away in section, of the lug ring of the interlock assembly of the packer of FIG. 8.

When releasing the packer, if the tubing string and mandrel cannot be rotated due to some binding or other problem, the tubing string and mandrel are pulled upwardly applying a shearing force to the pins 102, shearing the pins and releasing the bottom retainer 101 of the packer element assembly. The ring 101 will travel downwardly along the mandrel section 40 to the catcher ring 112. The housing 65 with the bottom wedge 45 will follow down on the mandrel until the shoulder 32 on the mandrel picks up the bottom wedge by engagement with the bottom wedge shoulder 72. The bottom wedge is pulled away from the lower ends of the slips and picks up the slip housing 42 by engagement of the wedge shoulder 71 with the housing shoulder 51 pulling the slips off of the top wedge 44. Also, the mandrel shoulder 26 will engage the internal shoulder 47 within the top wedge pulling the top wedge away from the upper ends of the slips 43. Thus, after the pins 102 are sheared, the continued pulling of the mandrel upwardly will space out the various components of the packer relaxing the packer element assembly 12 and retracting the slips 13 until the emergency release mode of the packer is obtained as illustrated in FIG. 3. During this emergency pulling procedure, the interlock assembly 15 remains on the lower threads 24 of the mandrel. The packer then must be pulled from the well as it cannot be moved and reset. The packer is returned to the running mode of FIG. 1 and the bottom retainer ring 101 resecured with the mandrel by new shear pins 102.

Figure 10:
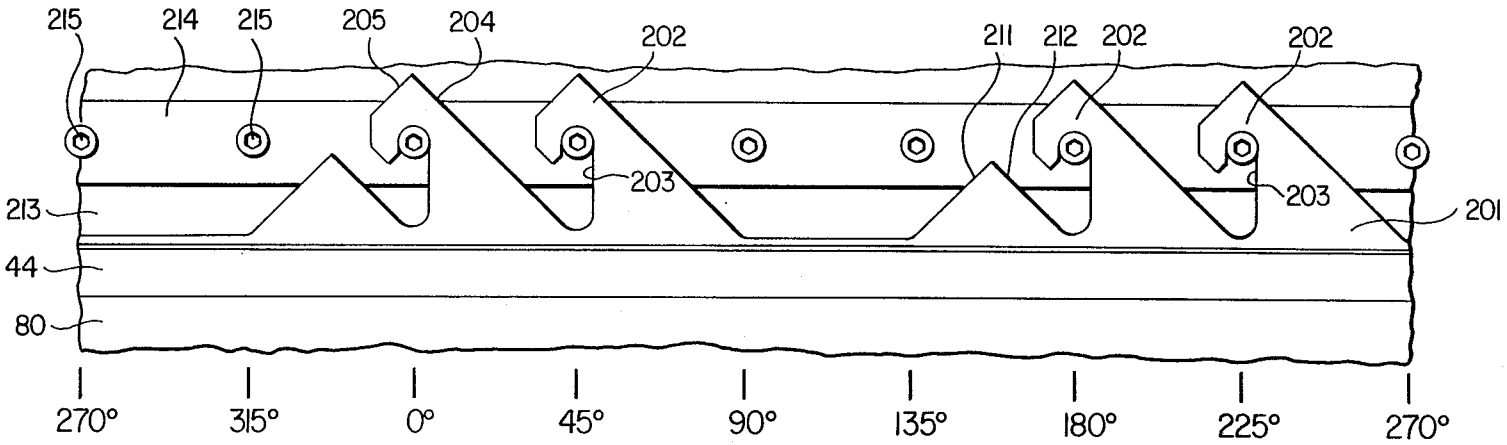
FIG. 10 is a fragmentary circumferential development of an upper portion of the packer of FIG. 8 showing the J-slot flange on the drag spring assembly housing, the lug ring of the interlock assembly, and the threaded portion of the mandrel on which the lug ring is mounted.

Referring to FIGS. 8–11, a second embodiment 200 of the packer of the invention includes a different interlock assembly from that of the packer 10 shown in FIGS. 1–7. The features of the packer 200, other than the interlock assembly, are identical to the packer 10, as previously illustrated and described. The upper wedge and interlock assembly retainer ring 44 of the packer 200 is provided with a J-slot flange 201 having a plurality of circumferentially spaced hooks 202, each defining an internal J-slot 203 and an external guide surface 204 along an upwardly facing edge of each of the hooks. Each of the hooks also has a guide surface 205 which slopes upwardly toward the surface 204 providing a pointed upper end to each of the hooks. In the particular form of the flange shown, two pairs of hooks are used on opposite sides of the flange. As illustrated in FIG. 10, the pairs of hooks are spaced 180 degrees apart around the flange. It will be recognized that the entire flange may comprise the circumferentially spaced hooks. The four illustrated are sufficient to perform the running and pulling functions necessary. The flange 201 also includes guide wedges 210 which have upwardly convergent guide edge surfaces 211 and 212 which converge together to a point at the upward end of each of the wedges. The mandrel 11 of the packer 200 has external threads 213 for connection with a tubing string and mounting the lug ring of the interlock assembly. An internally threaded lug ring 214 is mounted on the mandrel threads 213 as represented in FIGS. 8 and 10–13. A plurality of circumferentially spaced lugs 215 are mounted in the ring 214. Each of the lugs 215 has a shank threaded through the ring 214 into blind holes 216 in the mandrel to prevent rotation of the ring on the mandrel. The lugs coact with the J-slots 203 during the running and pulling modes of the packer. The lugs 215 are mounted around the entire ring with the same spacing between the lugs as provided between the J-slots as evident in FIGS. 8 and 10. A further modification in the packer 200 is the replacement of the running segments 90, FIG. 4, with locking segments 91 thus providing a complete ring of locking segments 91 within the recess 61 of the ring 44. It is necessary that all of the segments within this recess be the right-hand threaded locking segments as the running function is provided by the lugs on the bolts 215 and the J-slots 203. The other structural features of the packer 200 are identical to features of the packer 10 as previously described and illustrated. From a dimension standpoint the packer 200 must be slightly longer than the packer 10. The vertical travel of the lugs in the J-slots 203 requires additional length in the features of the packer 200 in units of measurement equal to the length of the travel of the lugs permitted by the J-slots. In particular models constructed this unit of length is approximately one inch. A total of approximately six units of length were added to the mandrel 11 of the packer 200 at the following locations along the length of the mandrel: one unit between the upper ends of the slips 43 and the cone portion 44; one unit between the lower ends of the slips 43 and the lower cone 45; two units in the length of the tubular body 65; and one unit between the ring 100 and the ring 101. These additional lengths are simply to permit the necessary longitudinal movement of the mandrel for the operation of the lug in the J-slots. The right-hand threads 24 on the mandrel which are engaged by the locking segments 91 during the operation of the packer is the same as on the mandrel 11 of the packer 10. The left-hand threads 22 used with the running segments are not, however, on the mandrel 11 of the packer 200 because the function of the left-hand threads and the running segments 90 in the packer 10 is performed in the packer 200 by the J-slot flange 201 and the lugs 215.

Figure 12:
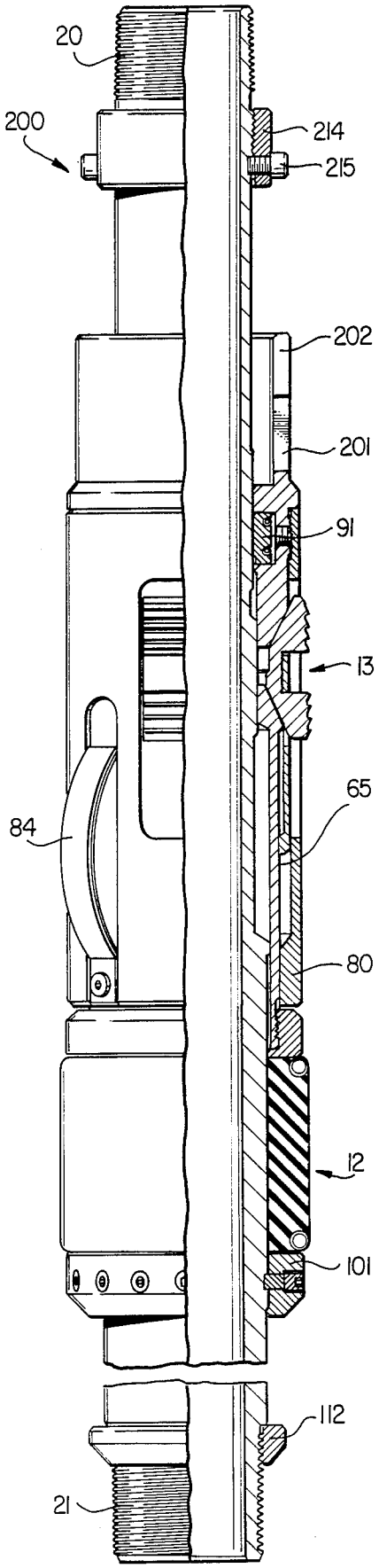
FIG. 12 is a longitudinal view in section and elevation of the packer of FIG. 11 in the set mode.
Figure 13:
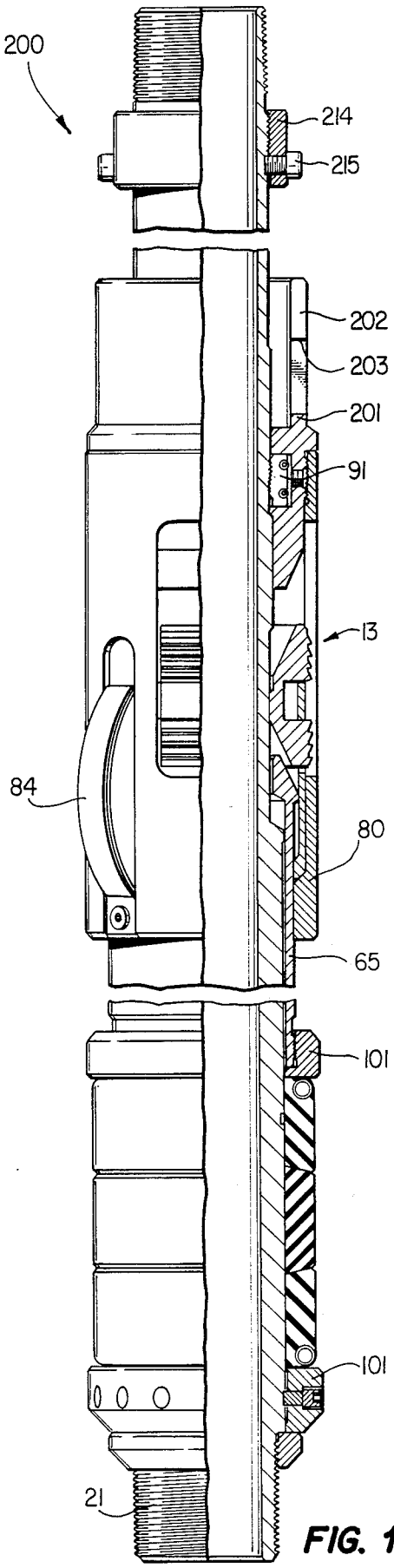
FIG. 13 is a longitudinal view in section and elevation of the packer of FIGS. 11 and 12 in the emergency release mode for pulling the packer.

The sequence of operating steps of the packer 200 are essentially the same as those for the packer 10 . The packer 200 is run in the mode represented in FIGS. 8 and 11 in which the lugs 215 are engaged in the vertical portions of the J-slots 203 and thus may move vertically the length of the slot as the mandrel is raised and lowered while the drag spring assembly resists vertical movement in the various steps of operation. As the packer is lowered in the well bore, the drag spring assembly is urged upwardly on the mandrel by the friction between the drag springs and the well bore wall so that the drag spring assembly is at the upper end position at which the lugs 215 are at the lower ends of the vertical portions of the J-slots. The various parts of the packer will remain in the relative positions shown in FIG. 11 while the packer is being lowered to the desired location in a well bore. In this running mode the locking segments 91 of the interlock assembly, FIG. 4, are along the smooth and non-threaded portion of the mandrel 11 above the right-hand threads 24 so that the locking segments are not coupled with the mandrel. At the desired depth in the well bore the tubing string is rotated to the right, or clockwise, as viewed from the surface, while simultaneously the tubing string and thus the packer mandrel 11 is lifted. The lugs 215 are at the lower ends of the J-slots as evident in FIG. 11. When the mandrel is rotated clockwise and lifted the lugs 215 travel along the J-slots guide surfaces 204 disengaging the lugs from the J-slots. When the lugs are fully disengaged the mandrel is uncoupled from the J-slots flange 201 and thus disengaged from the drag spring and slip assembly which is held against upward movement by the drag springs 84. Continued lifting of the tubing string and packer mandrel 11 raises the packer element assembly 12 and the lower wedge 45, as previously described, until the lower wedge 45 engages the lower ends of the slips 43 which are forced outwardly against the well bore wall, with continued upward movement of the mandrel thereafter compressing the packer element assembly 12 expanding the assembly to seal between the mandrel and the well bore wall. As the mandrel is lifted relative to the drag spring and slip assembly, the locking segments 91 ratchet downwardly along the right-hand threads 24 on the mandrel so that when the bottom wedge 45 is driven tightly underneath the lower ends of the slips 43 and the packer element assembly 12 is expanded, the locking segments are urged back inwardly by the springs 93 with the segments engaging the threads 24 to lock the mandrel at an intermediate upward position. The locking segments 91 are now engaged with the mandrel and the tubing string and the mandrel are lowered so that the upper wedge 44 is urged downwardly along with the drag spring assembly driving the upper wedge underneath the upper ends of the slips 43 to firmly set the upper ends of the slips. Due to the unique design of the drag spring and slip assembly, the drag spring housing 80 along with the upper wedge may move downwardly relative to the slips 43. During the setting of the upper ends of the slips with the wedge 44 some of the compression of the packer assembly is relieved, though sufficient compression remains for the packer element to act as a spring holding the lower wedge in position underneath the lower ends of the slips 43. The tubing string and packer mandrel are now lifted back upwardly to again fully expand the packer element assembly 12. During this final stage in the setting of the packer, the locking elements 91 again ratchet along the threads 24 as the mandrel 11 is lifted relative to the slips and locking segments 91. When the packer 12 is again fully expanded and compressed as represented in FIG. 12, the locking segments engaged with the threads 24 hold the mandrel 11 at the upper locked position. The relative positions of all of the packer components are illustrated in FIG. 12.

The packer 100 may be released in the well bore and reset following the same steps described with respect to the packer 10. The tubing string and packer mandrel are lowered and simultaneously rotated to the right, clockwise as seen from above, threading the locking segments 91 upwardly on the threads 24 along the mandrel until the segments reach the smooth wall portion of the mandrel above the threads 24 at which point the mandrel is released for continued downward movement relative to the drag spring and slip assembly. The mandrel moves downwardly within the drag spring and slip carrier assembly, the lower wedge 45 and the wedge housing 65, the upper retainer ring 100 and the expanded packer element assembly 12. The bottom retainer ring 100 moves downwardly with the mandrel releasing the compression in the packer element assembly 12. When the mandrel flange 33 reaches the top retainer ring 100, the bottom wedge housing 65 and the bottom wedge 45 are pulled downwardly from under the lower ends of the slips 43. With continued downward movement of the mandrel, the shoulder 71 on the bottom wedge 45 engages the shoulder 51 within the slip housing 42 pulling the slips 43 downwardly off of the upper wedge 44. Thus, the packer element assembly 12 is decompressed and the slips 43 are released from the well bore wall. When the lugs 215 reach the J-slot flange 201, the lugs strike the guide surfaces 204 directing the lugs downwardly into the J-slots 203 re turning the packer to the running mode 11. The packer may then be lowered or raised and reset in accordance with the previous description.

In the event that the tubing string and the mandrel cannot be rotated releasing the mandrel from the interlock assembly for relocating or pulling the mandrel, the emergency procedure previously described with respect to the packer 10 may also be used with the packer 200. The packer is in the set or locked mode of FIG. 12. The tubing string and mandrel are pulled upwardly applying a shearing force to the pins 102 shearing the pins and releasing the bottom retainer 101 of the packer assembly 12 so that the mandrel may be pulled upwardly relative to the packer assembly. The various parts of the packer are spaced out on the mandrel as previously described and illustrated in FIG. 13, with the packer element assembly 12 relaxed and retracted, and the slips 43 released from the well bore wall. The packer is then pulled from the well bore as it cannot be reset in the well until it is returned to the surface and the shear pins 102 are replaced for re-running of the packer.

It will now will be seen that a new and improved well packer which is substantially shorter than prior art packers and can be run, set, released, and reset in a well bore has been described and illustrated. One particular area of novelty of this new packer is the use of the interlock assembly with the slip assembly associated with the drag spring and slip carrier assembly which includes the slip housing 42 as a movable member within the slip carrier 80. Such an arrangement provides a longitudinally compact assembly where the prior art required a separate drag spring and interlock assembly. A further area of novelty in the present packer is the employment of formed springs 73 in place of the more expensive and complex coil spring arrangements used with prior art slips to bias slips inwardly. Such new design features have reduced the length of the packer by approximately one half in comparison with prior art packers, and the cost has been reduced approximately sixty percent over prior art packers.

What is claimed is:

1. A well packer comprising:

a tubular mandrel having a central longitudinal flow passage, an annular packer element assembly on said mandrel for sealing around said mandrel with a well bore wall;

a drag spring and slip carrier assembly movably mounted on said mandrel;

a slip assembly in said drag spring and slip carrier assembly including a slip housing movable within and relative to said drag spring and slip carrier assembly; and an interlock assembly associated with said drag spring and slip carrier assembly for selectively coupling said mandrel with said slip assembly and said drag spring and slip carrier assembly to set and release said packer in a well bore, said interlock assembly including arcuate running segments for holding said packer in a release mode and arcuate locking segments for setting and releasing said packer in a well bore.

2. A well packer according to claim 1 wherein said mandrel has first threads formed in a first direction and second threads spaced from said first threads and formed in an opposite direction, said first threads coacting with said running segments when said packer is in a running mode and said second threads coacting with said locking segments for setting and locking said packer in a well bore.

3. A well packer according to claim 2 wherein said first threads are left-hand threads and said running segments have internal left-hand thread portions and said second threads are right-hand threads and said locking segments have internal right-hand thread portions.

4. A well packer according to claim 3 wherein said slip assembly includes locking slips mounted in windows in said slip housing and said slips with said slip housing are longitudinally movable within and relative to said slip carrier.

5. A well packer according to claim 4 where said drag spring and slip carrier assembly includes a tubular slip carrier having windows for said slips, said windows being longer than said slips to permit relative movement between said slip carrier and said slips and said slip housing during setting and releasing said packer.

6. A well packer according to claim 5 including an upper wedge for setting upper ends of said slips, said upper wedge being secured with said drag spring and slip carrier assembly for movement with said assembly relative to said slips.

7. A well packer according to claim 6 wherein said interlock assembly is positioned in an annular recess in an annular ring secured in an upper end of said slip carrier and integral with said upper wedge.

8. A well packer according to claim 7 including a lower wedge movable between said slip housing and said mandrel for expanding lower ends of said slips, said lower wedge including an integral tubular housing secured at a lower end thereof with an upper end of said packer element assembly.

9. A well packer according to claim 8 including an upper packer element retainer ring slidable on said mandrel at the upper end of said packer element assembly and secured on the lower end of said lower wedge housing.

10. A well packer according to claim 9 including a bottom retainer ring secured on said mandrel at the lower end of said packer element assembly and movable downwardly on said mandrel for emergency release of said packer, shear pins holding said bottom retainer ring against longitudinal movement on said mandrel, and a catcher ring secured on the lower end of said mandrel for holding said packer element assembly and said bottom wedge on said mandrel in an emergency release mode of said packer.

11. A Well packer according to claim 10 including formed springs arranged in end-to-end array around said slips in said slip housing and latched on said slips for biasing said slips inwardly toward said mandrel.

12. A well packer according to claim 11 where each of said slips has a central outwardly opening transverse recess, upper and lower outer toothed portions above and below said recess, and a central connecting portion defining a bottom of said recess, and one of said formed springs extends across and is latched to each of said slips over said central connecting portion of said slip to hold said slip and bias said slip inwardly.

13. A well packer according to claim 12 where each said formed spring has straight opposite end portions extending outwardly at an angle in opposite directions when said spring is installed in said packer so that said end portions are compressed between said mandrel and an inner wall of said slip housing to urge the central portion of said spring inwardly, and each said spring has a central substantially rectangular three sided central portion between said end portions, said central portion being shaped to latch over and grip said central portion of said slip.

14. A well packer according to claim 3 where said first and said second threads on said mandrel and said thread portions in said running and said locking segments are buttress type threads oriented to permit said running segments to ratchet upwardly on said first threads on said mandrel and to permit said locking segment to rachet downwardly on said second threads on second mandrel, said threads in said running segments meshing with said first threads on said mandrel responsive to relative upward movement of said mandrel in said running segments, said threads in said locking segments meshing with said second threads on said mandrel in the set mode of said packer.

15. A well packer according to claim 14 where said running segments and said locking segments are held inwardly around said mandrel by garter spring means.

16. A well packer according to claim 15 where said running and said locking segments are arranged in annular end-to-end array around said mandrel in said recess in said upper wedge and annular ring member and retaining screws are engaged through said ring into said locking segments, the head of each said screws being slidable in a radial recess of said ring to permit said segments to move inwardly and outwardly while being held against circumferential movement around said mandrel within said recess.

17. A well packer for sealing an annular space in a well bore around a well tubing comprising:

a longitudinal mandrel having a longitudinal central flow passage therethrough and threaded opposite end portions for connecting said mandrel with a tubing string, said mandrel being provided with first external threads formed around said mandrel in a first direction, second external threads spaced below said first threads formed around said mandrel in an opposite direction, a first external annular stop shoulder around said mandrel below said second threads for limiting relative downward movement on said mandrel of an upper wedge, a second external annular upwardly facing stop shoulder on said mandrel limiting downward movement on said mandrel of a bottom wedge, a third external annular downwardly facing stop shoulder on said mandrel limiting upward movement of an upper retainer ring of a packer element assembly, and a fourth downwardly facing external annular stop shoulder limiting upward movement of a bottom retainer ring of a packer element assembly;

a packer element assembly mounted on said mandrel below said third external annular stop shoulder for radial expansion around said mandrel to seal between said mandrel and a well bore wall;

an upper stop ring mounted on said mandrel at the upper end of said packer element assembly below said third stop shoulder on said mandrel;

a bottom retainer ring mounted on said mandrel at the lower end of said packer element assembly and movable downwardly from said fourth annular stop shoulder on said mandrel;

shear pins releasably securing said bottom retainer ring to said mandrel for emergency release of said bottom retainer ring;

a catcher ring on said mandrel along said lower threaded end portion of said mandrel for holding said bottom retainer ring on said mandrel when said shear pins are sheared;

a drag spring and slip carrier assembly on said mandrel including a tubular slip carrier having circumferentially spaced longitudinal slip windows therein and an upper wedge and annular ring secured in the upper end of said slip carrier, said ring having an internal annular interlock assembly recess formed therein;

a bottom wedge having a tubular housing slidably positioned on said mandrel between said mandrel and said slip carrier, said housing being connected at a lower end with said top packer assembly retainer ring;

a tubular slip housing positioned within said slip carrier around said bottom wedge and bottom wedge housing, said slip housing having circumferentially spaced slip windows and a slip retainer housing section at the upper end of slip windows;

a plurality of circumferentially spaced, radially expandable and contractible, slips positioned within said slip housing and extendable through said slip housing windows and said slip carrier windows to engage a well bore wall around said packer for locking said packer with said well bore wall, each of said slips having upper and lower external toothed portions and a central recess, the bottom of said recess being defined by a connecting slip portion between said upper and lower slip portions, said central slip portion being retained by said retainer portion of said slip housing to prevent said slips from moving radially outwardly from said slip housing;

a plurality of circumferentially spaced formed springs disposed end-to-end array around said mandrel within said slip housing, each of said springs having opposite end portions compressible between said housing and said mandrel and a central portion engagable with said central portion of each of said slips for biasing said slips radially inwardly towards said mandrel;

an interlock assembly within said recess of said annular ring of said drag spring and slip carrier assembly, said interlock assembly including circumferentially spaced running segments and locking segments arranged in end-to-end array, said running segments and said locking segments having internal thread portions formed in opposite directions, said thread portions in said running segments being engagable with said first threads on said mandrel and said thread portions in said locking segments being engagable with said second threads on said mandrel, said threads in said segments and on said mandrel being configured to permit said running segments to rachet along said first threads when said mandrel is moved downwardly relative to said running segments and to permit said locking segments to rachet upwardly relative to said second mandrel threads when said mandrel is moved relatively downwardly within said locking segments, said threads in said running segments meshing with first threads on said mandrel in the running mode of said packer and said threads within said locking segments meshing with said second threads on said mandrel in the locking mode of said packer;

garter spring means within said recess of said annular ring of said drag spring and slip carrier assembly around said running and locking segments of said interlock assembly to bias said segments inwardly around said mandrel, and screw means securing said segments with said annular ring to permit segments to move radially while holding said segments against circumferential movement around said mandrel within said recess; and circumferentially spaced longitudinally extending drag springs on said slip carrier for frictionally engaging a well bore wall around said slip carrier to restrain said slip carrier against longitudinal movement for setting and releasing said packer.

18. A well packer in accordance with claim 17 wherein said first threads on said mandrel and said thread portions in said running segments are left-hand threads and said second threads on said mandrel and said threads in said locking segments are right-hand threads.

19. A well packer comprising:

a tubular mandrel having a central longitudinal flow passage;

an annular packer element assembly on said mandrel for sealing around said mandrel with a well bore wall;

a drag spring and slip carrier assembly movably mounted on said mandrel;

a slip assembly in said drag spring and slip carrier assembly including a slip housing movable within said drag spring and slip carrier assembly; and an interlock assembly associated with said drag spring and slip carrier assembly for selectively coupling said mandrel with said slip assembly and said drag spring and slip carrier assembly to set and release said packer in a well bore, said interlock assembly including arcuate locking segments for setting and releasing said packer in a well bore, an operating flange on said drag spring and slip carrier assembly provided with circumferentially spaced upwardly opening J-slots, and an operating lug ring on said mandrel having circumferentially spaced lugs operable with said J-slots for coupling said mandrel with said drag spring and slip carrier assembly when running and pulling said packer and for release of said mandrel from said drag spring and slip carrier assembly for setting and locking said packer in a well bore and for release of said packer in said well bore.

20. A well packer in accordance with claim 19 wherein said interlock assembly arcuate locking segments are adapted to be coupled with and released from said mandrel for setting and releasing said packer in a well bore.

21. A well packer according to claim 20 wherein said the mandrel has external threads and said arcuate locking segments have internal threads for selectively coupling said mandrel with said interlock assembly for setting said packer.

22. A well packer according to claim 21 wherein said slip assembly includes locking slips mounted in windows in said slip housing and said slip carrier is longitudinally movable relative to said slips and said slip housing.

23. A well packer according to claim 22 wherein said drag spring and slip carrier assembly includes a tubular slip carrier having windows for said slips, said windows being longer than said slips to permit relative movement between said slip carrier and said slips and said slip housing during setting and releasing said packer.

24. A well packer according to claim 23 wherein said drag spring and slip carrier assembly includes an annular ring on the upper end of said slip carrier having an internal annular recess and said locking segments are positioned in circumferentially spaced array within said recess around said mandrel and garter spring means around said locking segments for biasing said locking segments inwardly around said mandrel.

25. A well packer according to claim 24 wherein said slip assembly includes an upper wedge for setting the upper ends of said slips and a lower wedge for setting the lower ends of said slips.

26. A well packer in accordance with claim 25 wherein said slips and said upper and lower wedges are mounted within a slip carrier and drag springs are mounted on said slip carrier and said operating flange including said J-slots is connected with said slip carrier.

27. A well packer in accordance with claim 26 wherein said operating lug ring is secured on said mandrel.

28. A well packer comprising:

a mandrel having a longitudinal flow passage therethrough;

a packer element assembly mounted on said mandrel for longitudinal compression for expanding said packer element assembly to seal around said mandrel with a well bore wall; locking slips circumferentially spaced around said mandrel for radial expansion to lock said packer with a well bore wall;

a slip housing around said slips holding said slips in operating positions around said mandrel;

a slip carrier around said slip housing, said slip housing being longitudinally movable within said slip carrier;

upper and lower wedges within said slip carrier for engaging the upper and lower ends of said slips for expanding said slips; and interlock means connected with said slip carrier for selectively coupling said mandrel with said slip carrier for operating said packer between running, setting and locking, and release modes.

29. A well packer in accordance with claim 28 wherein said mandrel has external running threads out in a first direction and external locking threads cut in a second opposite direction and said interlock means comprises an annular assembly within said slip carrier around said mandrel including a plurality of running segments operable with said first threads on said mandrel and a plurality of locking segments operable with said locking threads on said mandrel.

30. A well packer in accordance with claim 28 wherein said mandrel has external locking threads and said interlock means includes circumferentially spaced locking segments in said slip carrier having threads engageable with said locking threads on said mandrel for setting and locking said packer, a J-slot flange on said slip carrier around said mandrel having upwardly opening J-slots, and an operating lug ring secured on said mandrel having circumferentially spaced operating lugs adapted to engage and release from said J-slots for releasably coupling said mandrel with said slip carrier for running said packer in a well bore.

31. A well packer for sealing an annular space in a well bore around the well tubing comprising:

a longitudinal mandrel having a longitudinal central flow passage therethrough and threaded opposite end portions for connecting said mandrel with a tubing string, said mandrel being provided with external locking threads formed around said mandrel in a first direction, a first external annular stop shoulder around said mandrel below said locking threads for limiting relative downward movement on said mandrel of an upper wedge, a second external annular upwardly facing stop shoulder on said mandrel limiting downward movement on said mandrel of a bottom wedge, a third external annular downwardly facing stop shoulder shoulder on said mandrel limiting upward movement of an upper retainer ring of a packer element assembly, and a fourth downwardly facing external annular stop shoulder limiting upward movement of a bottom retainer ring of a packer element assembly;

a packer element assembly mounted on said mandrel below said third external annular stop shoulder for radial expansion around said mandrel to seal between said mandrel and the well bore walls;

an upper stop ring mounted on said mandrel at the upper end of said packer element assembly below said third stop shoulder on said mandrel;

a bottom retainer ring mounted on said mandrel at the lower end of said packer element assembly and the movable downwardly from said fourth annular stop shoulder on said mandrel;

shear pins releasably securing said bottom retainer rings to said mandrel for emergency release of said bottom retainer rings;

a catcher ring on said mandrel along said lower threaded end portion of said mandrel for holding said bottom retainer ring on said mandrel when said shear pins are sheared;

a drag spring and slip carrier assembly on said mandrel including a tubular slip carrier having circumferentially spaced longitudinal slip windows therein and an upper wedge and annular ring secured in the upper end of said slip carrier, said ring having an internal annular interlock assembly recess formed therein;

a bottom wedge having a tubular housing slidably positioned on said mandrel between said mandrel and said slip carrier, said housing being connected at a lower end with said top packer assembly retainer ring;

a tubular slip housing positioned within said slip carrier around said bottom wedge and said bottom wedge housing, said slip housing having circumferentially spaced slip windows and a slip retainer housing section at the upper end of said slip windows;

a plurality of circumferentially spaced, radially expandable and contractable, slips positioned within said slip housing and extendable through said slip housing windows and the said slip carrier windows to engage a well bore wall around said packer for locking said packer with said well bore wall, each of said slips having upper and lower external toothed portions and a central recess, the bottom of said recess being defined by a connecting slip portion between said upper and lower slip portions, said central slip portion being retained by said retainer portion of said slip housing to prevent said slips from moving radially outwardly from said slip housing;

a plurality of circumferentially spaced formed springs disposed in end-to-end array around said mandrel within said slip housing, each of said springs having opposite end portions compressable between said housing and said mandrel and a central portion engagable with said central portion of each of said slips for biasing said slips radially inwardly toward said mandrel;

an interlock assembly within said recess of said annular ring of said drag spring and slip carrier assembly, said interlock assembly including circumferentially spaced locking segments arranged in end-to-end array, said locking segments having internal thread portions formed in a first direction to mate with said locking threads on said mandrel, said threads in said segments and on said mandrel being configured to permit said segments to ratchet along said mandrel threads when said mandrel is moved downwardly within said locking segments, said threads within said locking segments meshing with said threads on said mandrel in the locking mode of said packer;

garter spring means within said recess of said annular ring of said drag spring and slip carrier assembly around said locking segments to bias said segments inwardly around said mandrel, and screw means securing said locking segments with same said annular ring to permit segments to move radially while holding said segments against circumferential movement around said mandrel within said recess;

circumferentially spaced longitudinally extending drag springs on said slip carrier for frictionally engaging a well bore wall around said slip carrier to restrain said slip carrier against longitudinal movement for setting and releasing said packer;

an annular J-slot flange having upwardly opening circumferentially spaced J-slots on said slip carrier around said mandrel; and an operating lug ring secured on said mandrel having circumferentially spaced operating lugs adapted to engage said J-slots in said J-slot flange and release from said J-slots for releasably coupling said mandrel with said slip carrier for running and pulling said well packer in a well bore.

32. A well packer comprising:

a tubular mandrel having a central longitudinal flow passage;

an annular packer element assembly on said mandrel for sealing around said mandrel with a well bore wall;

a drag spring and slip carrier assembly movably mounted on said mandrel;

a slip assembly in said drag spring and slip carrier assembly including a slip housing movable within and relative to said drag spring and slip carrier assembly; and an interlock assembly associated with said drag spring and slip carrier assembly for selectively coupling said mandrel with said slip assembly and said drag spring and slip carrier assembly to set and release said packer in a well bore.

* * * * *